US007172153B2

(12) United States Patent
Speck

(10) Patent No.: US 7,172,153 B2
(45) Date of Patent: Feb. 6, 2007

(54) WIRE GUIDE FOR A WIRE PROCESSING MACHINE, IN PARTICULAR FOR A SPRING MANUFACTURING MACHINE

(75) Inventor: Norbert Speck, Reutlingen (DE)

(73) Assignee: WAFIOS Aktiengesellschaft, Reutlingen (DE)

( * ) Notice: Subject to any disclaimer, the term of this patent is extended or adjusted under 35 U.S.C. 154(b) by 123 days.

(21) Appl. No.: 11/084,483

(22) Filed: Mar. 18, 2005

(65) Prior Publication Data

US 2005/0204797 A1 Sep. 22, 2005

(30) Foreign Application Priority Data

Mar. 18, 2004 (EP) ..... 04006590

(51) Int. Cl.
*B65H 23/04* (2006.01)
*B21D 43/16* (2006.01)

(52) U.S. Cl. ..... 242/615; 242/615.3; 72/140; 72/142; 72/428

(58) Field of Classification Search ..... 242/615, 242/615.3, 615.4, 397, 548, 566, 157 R; 226/196.1; 72/135, 137, 140, 142, 428
See application file for complete search history.

(56) References Cited

U.S. PATENT DOCUMENTS 4,825,678 A * 5/1989 Post
5,201,208 A * 4/1993 Jacobson ..... 72/140
5,625,942 A * 5/1997 Casey
5,730,017 A * 3/1998 Jacobson ..... 72/140
5,791,184 A * 8/1998 Wu ..... 72/140
5,839,312 A 11/1998 Itaya
5,887,471 A * 3/1999 Itaya ..... 72/140
6,098,444 A 8/2000 Wu
6,142,002 A * 11/2000 Itaya ..... 72/140
6,151,942 A * 11/2000 Itaya

FOREIGN PATENT DOCUMENTS

| | | |
|---|---|---|
| DE | 44 47 253 A1 | 1/1996 |
| EP | 0 930 112 A2 | 7/1999 |
| JP | 08252645 | 10/1996 |
| JP | 11033659 | 2/1999 |

* cited by examiner

*Primary Examiner*—William A. Rivera
(74) *Attorney, Agent, or Firm*—Patterson, Thuente, Skaar & Christensen, P.A.

(57) ABSTRACT

A molded body is tightly fitted to the wire guide block on the side facing the collet and laterally to the guide groove that is braced against the collet via attachment media coming in from the side of the collet and is attached to the latter in a wire guide for a wire processing machine, in particular a spring manufacturing machine. It is also used to guide a wire feed to wire processing tools and is attached to a wire guide block with a collet, thereby forming a guide groove for the wire.

16 Claims, 4 Drawing Sheets

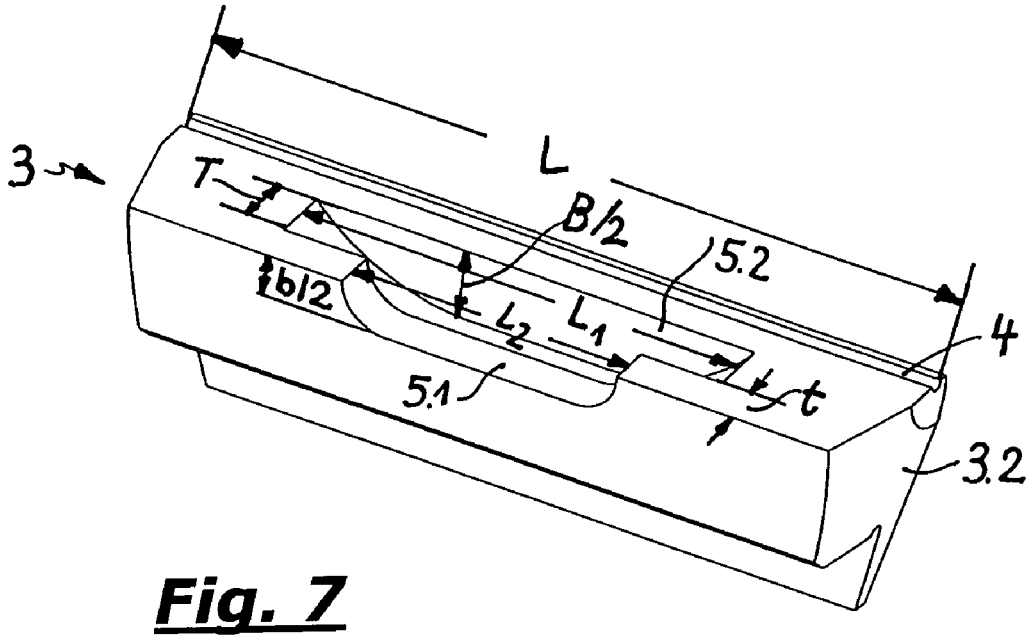
Fig. 7
Fig. 8
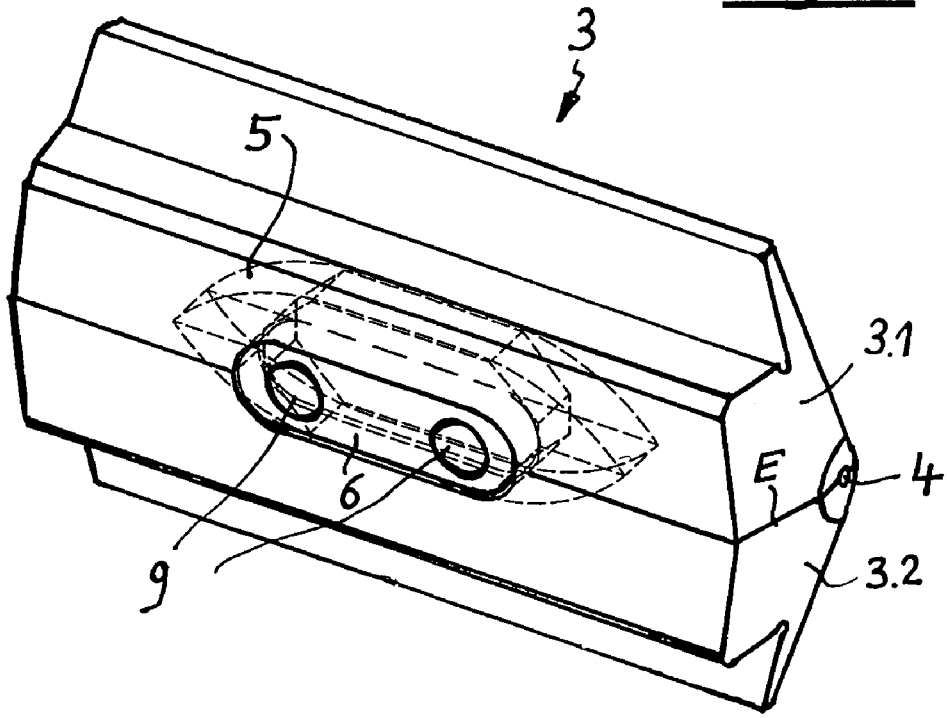

WIRE GUIDE FOR A WIRE PROCESSING MACHINE, IN PARTICULAR FOR A SPRING MANUFACTURING MACHINE

FIELD OF THE INVENTION

The invention concerns a wire guide for a wire-processing machine, as can be used in particular for spring manufacturing machines, for guiding a wire feed to wire processing tools. It also includes a collet to which a detachable wire guide block is attached, which forms a guide groove for the wire.

BACKGROUND OF THE INVENTION

To save space and with the goal of achieving a desired sleekness of design, known wire guides for wire processing machines are normally attached to the collet using clamps (in the form of outer clamps) applied from the side of the wire guide facing away from the collet. Because applying a clamp with only one screw does not allow for optimal clamping force, is customary to use two screws each when screwing in the clamps. In addition, two clamps are used for the purpose of distributing the clamping force, one above and one below the guide groove in the wire guide block; this is relatively expensive.

Other known wire guides consist of two halves, with each half screwed separately into the collet. A thread insert is soldered into the respective wire guide half for the purpose of accommodating the screw. However, when soldering in such thread inserts, the wire guide shows distortion, which is undesirable, caused by stress due to heat. In addition, the thread insert can be pulled out of its bore if the screw is tightened too much or if the screw used is too long, making the wire guide unusable. Even when using only one screw per wire guide half for the attachment, the result is a less than optimal clamping force.

SUMMARY OF THE INVENTION

Based on the above, the purpose of the invention is to develop a wire guide that eliminates most of the aforementioned disadvantages and which, in particular, no longer uses thread inserts.

This purpose is achieved in the invention with a wire guide of the type mentioned in the introduction by tightly fitting a molded body to the wire guide block on the side facing the collet and laterally to the guide groove that originates from the side of the collet, which jams the attachment media against the collet. It is then attached to the collet.

In the wire guide according to the invention, it is possible to forgo the special thread insert attachment. Moreover, the invention has the advantage that it jams against the collet via suitable attachment media from the side of the collet with only one central clamp, i.e., via the molded body tightly fitted to it. This allows central attachment, i.e., at the level of the guide groove. This is because interference between the attachment media and the guide groove can be avoided easily due to the tight fit of the molded body. This body lies laterally between the guide groove and the collet. The attachment media actuate on it from the side of the collet. If the wire guide according to the invention is designed with two wire guide halves, it has the additional advantage that simultaneous attachment of both halves to the collet is possible even though there is only one molded body. This thereby increases the safety of assembly and manufacture and makes it possible to achieve attachment relatively quickly and precisely, making it possible to force the wire guide more effectively against the collet, i.e., with even greater force. It is therefore possible to apply optimal clamping force. It is possible to mount the wire guide onto the collet according to the invention particularly quickly and inexpensively compared to previously known solutions.

All suitable attachment members may be used as attachments in the wire guide according to the invention. However, the preferred use calls for least one, preferably two, fastening screws inserted through the collet from the side opposite the wire guide block.

A preferred embodiment of the wire guide according to the invention is that the molded body should fit into a molded collet formed in the wire guide block, which is designed as an open molded groove (particularly preferable), and which extends in the direction of the guide groove and opening toward the side of the collet. Other suitable embodiments of the molded collet are also conceivable. If the molded collet takes the form of a molded groove, the latter preferably has the form of an essentially T-shaped cross section perpendicular to the guide groove. This results in a molded groove with a shape that is geometrically simple, easy to manufacture and extraordinarily effective. It is also easy to fit a suitable molded body to it.

In this process, the molded groove may be designed in such a way that it extends along the entire length of the wire guide block. This facilitates threading of the tightly fitted molded body from one of the two end surfaces of the wire guide block.

Preferably, the screw head of each fastening screw used as an attachment member in the wire guide according to the invention is braced against a base plate inserted between it and the collet on the side facing away from the wire guide block. This affords a simple yet very effective means of bracing.

The wire guide block according to the invention may also have a great advantage in that it is designed in such a way that it is divided at the center of the guide groove into a plane [sic] perpendicular to the latter and thus consists of two wire guide block halves featuring half of the guide groove each (and also half of the molded collet or molded groove formed in the wire guide block). In this embodiment, the molded groove may also preferably extend only over a portion of the total length of the wire guide block. Here the first section of the molded groove opens toward the collet, as seen in the direction of the guide groove, preferably extending over a shorter length than the length of the adjoining second section of the molded groove lying further inside the wire guide block and forming the crossbar of the T-shaped cross section of the molded groove. In this way, the molded body to be fitted tightly into the molded collet can be inserted easily by first inserting it in one of the two wire guide block halves and then slipping the second half over it.

In the wire guide according to the invention, the molded body can be executed in any form suitable for a tight fit in the molded groove or the molded collet. Particularly preferable is a groove stone with two sections, whereby the first section fits into the first section of the molded groove toward the side of the collet. At the same time, the adjoining second section of the molded body fits into the second section of the molded groove, whereby its length and/or its width perpendicular to it is larger than the allocated length or width of the first section of the molded body. A molded body executed in such a way may preferably be used both for a continuous form groove and for the design of the molded collet extending only over a portion of the total length of the wire guide block (in case of divided wire guide block halves), and in turn is a form that can be manufactured relatively easily and inexpensively.

BRIEF DESCRIPTION OF THE DRAWINGS

The invention is explained in more detail and with basic examples below, whereby

FIG. 7 shows a basic exploded view of the lower half of a divided wire guide block according to the invention with a molded collet formed in it (half) for a molded body according to FIG. 3;

FIG. 8 shows a basic exploded view of the wire guide block corresponding to FIG. 4 for a wire guide according to the invention corresponding to FIG. 5 with a tightly fitted molded body (not mounted on it).

The same references have been used for the same parts in all wire guide embodiments shown in the illustrations.

FIGS. 1 to 4 show a first embodiment of a wire guide and FIGS. 5 to 8 show a different embodiment of a wire guide.

DETAILED DESCRIPTION OF THE DRAWINGS

Reference is first made to the first embodiment of an undivided wire guide shown in FIGS. 1 to 4.

Figure 1:
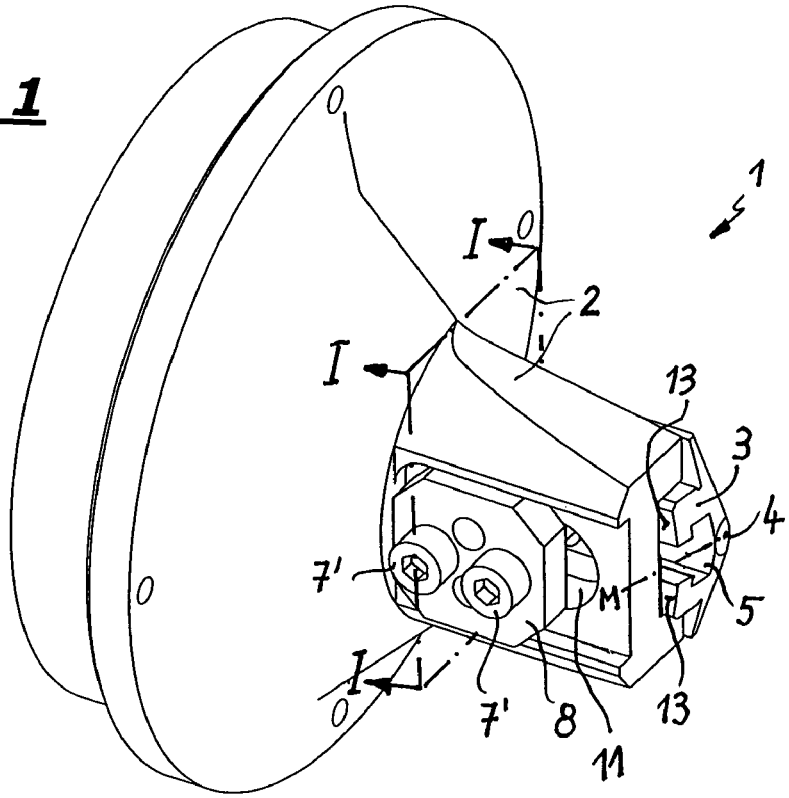
FIG. 1 shows an exploded view of a basic wire guide according to the invention mounted on a collet.

FIG. 1 shows the exploded view of a wire guide 1 from the front and at an angle, which has a collet 2 to which a wire guide block 3 has been attached, which in turn forms a guide groove 4 for a wire (not shown). In the embodiment shown, seen in the illustration in the direction from right to left, the wire guide block 3 is mounted on the right side of the collet 2 (or the part of collet 2 that serves for attaching the wire guide block 3).

Figure 4:
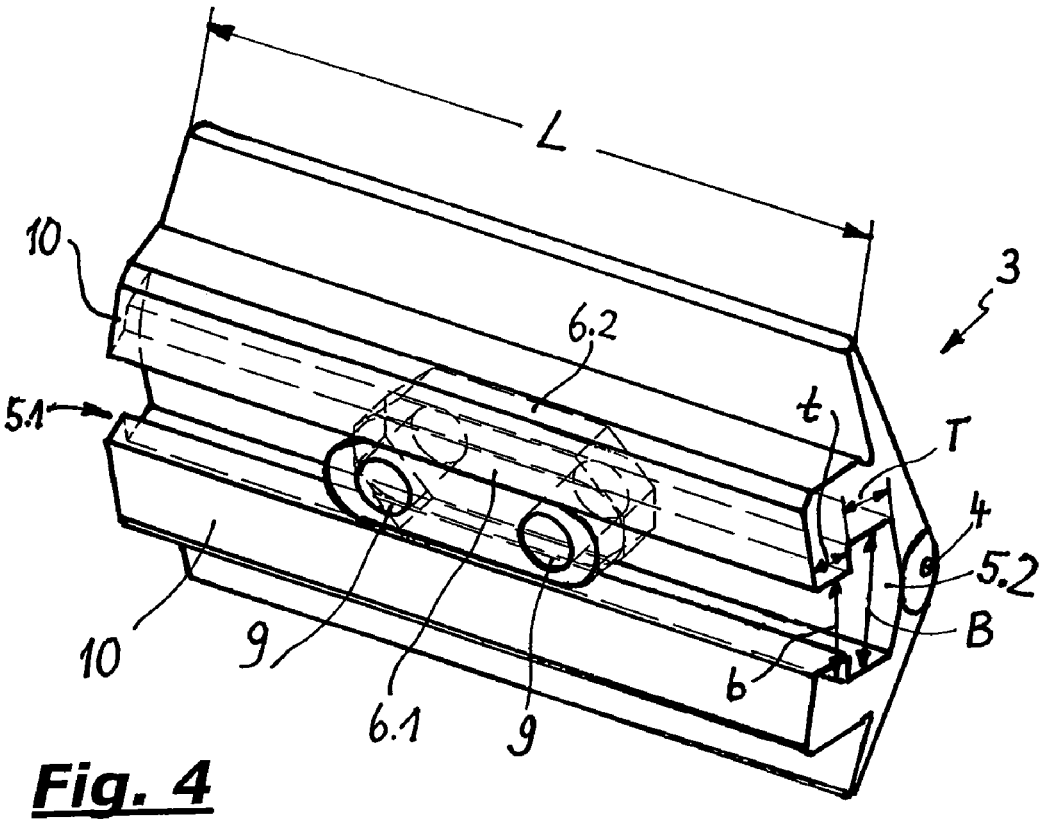
FIG. 4 shows a side view of a wire guide block of a wire guide device according to the invention with a tightly fitted molded body according to FIG. 3.
Figure 5:
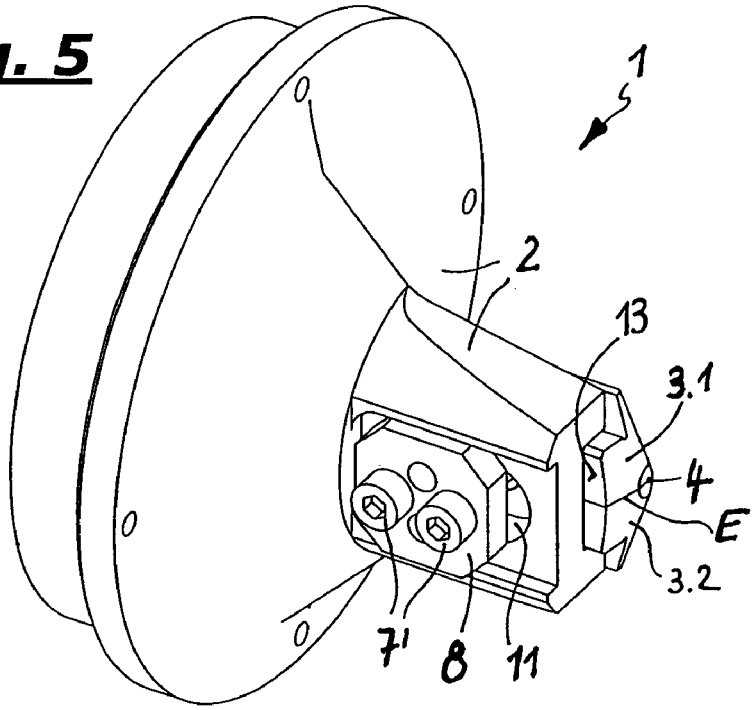
FIG. 5 shows a exploded view corresponding to FIG. 1 of a basic wire guide according to the invention with divided wire guide block.

The wire guide 1 is part of a spring coiling machine (not show) and comprises an undivided wire guide block 3 as shown in more detail in the enlarged view in FIG. 4.

As can be seen from FIGS. 1 and 4, there is a molded collet in the form of a molded groove opening toward the collet 2 on the side of the wire guide block 3 facing the collet 2 that is shown in a sectional cut perpendicular to the longitudinal direction of the wire guide block 3 or perpendicular to the wire guide groove, with the groove essentially having a T-shaped cross section.

Figure 3:
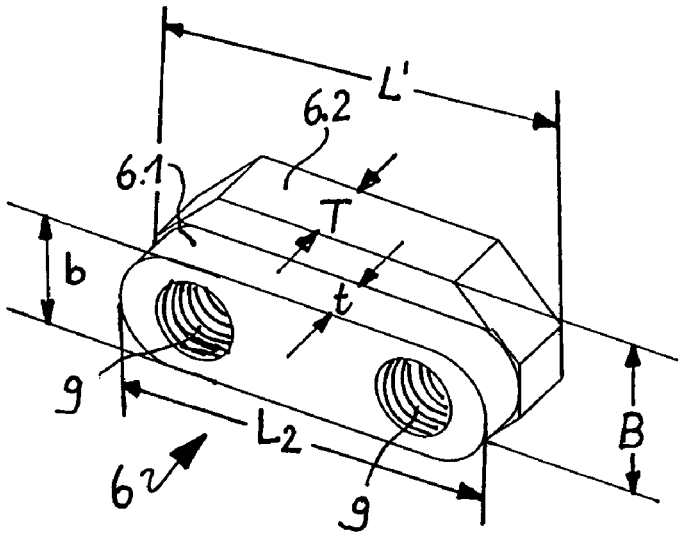
FIG. 3 shows an enlarged view of a molded body for a wire guide according to the invention.

A molded body 6 is tightly fitted into the molded groove 5 shown in more detail in an enlarged view in FIG. 3.

The molded body 6 actually consists of two molded sections, namely a first, smaller molded section 6.1, prone when mounted, in section 5.1 of the molded groove 5, which forms the cross bar of the T-shaped cross section of same and opens toward the collet 2 (see the view in FIG. 4, which shows the position of the molded body 6 mounted on the molded groove 5, with the hidden edges of the molded groove 5 and the inside portion of the molded body 6 being indicated by broken lines).

The larger section 6.2 of the molded body 6 adjoining section 6.1 protrudes in the mounted position into a section 5.2 lying inside the molded groove 5, which forms the cross bar of the T-shaped cross section of the molded groove 5 (as can be seen in FIG. 4). This (larger) section 6.2 of the molded body 6 has a length equal to L' and (perpendicular to the longitudinal direction of the molded groove 5) a width B, which, as shown in FIG. 3, is noticeably larger than the width b of the smaller section 6.2 (and projects beyond both sides in the illustrations thus: upward and downward, as can be seen in more detail especially in FIG. 4 and the enlarged sectional view in FIG. 2, with the latter corresponding to the position of the section that is indicated in FIG. 1 with I—I).

The molded body 6 is inserted from one of the two lateral end surfaces of the wire guide block 3 into the molded groove 5 until it reaches the desired position for the attachment, which corresponds to the position in FIG. 4. In this process, the width b of the smaller section 6.1 of the molded body 6 is as large as the corresponding width b of the section 5.1 of the molded groove 5, while the total width B of the larger section 6.2 of the molded body 6 is chosen to be as large as the total width B of the second section 5.2 of the molded groove 5 (of course with sufficient tolerance to allow a proper, tight, trouble-free insertion).

In the process, the depth t of the first section 6.1 of the molded body 6 (as measured diagonally to the longitudinal direction of the molded groove 5) is chosen to be as large as the corresponding depth t of the corresponding groove section 5.1 of the molded groove 5 opening toward the collet 2 (or somewhat smaller), while the depth T of the larger molded section 6.2 of the molded body 6 equals the depth T of the second section 5.2 of the molded groove 5 (here also: preferably somewhat smaller, allowing for an easy and safe insertion of the molded body 6 into the molded groove 5).

Figure 2:
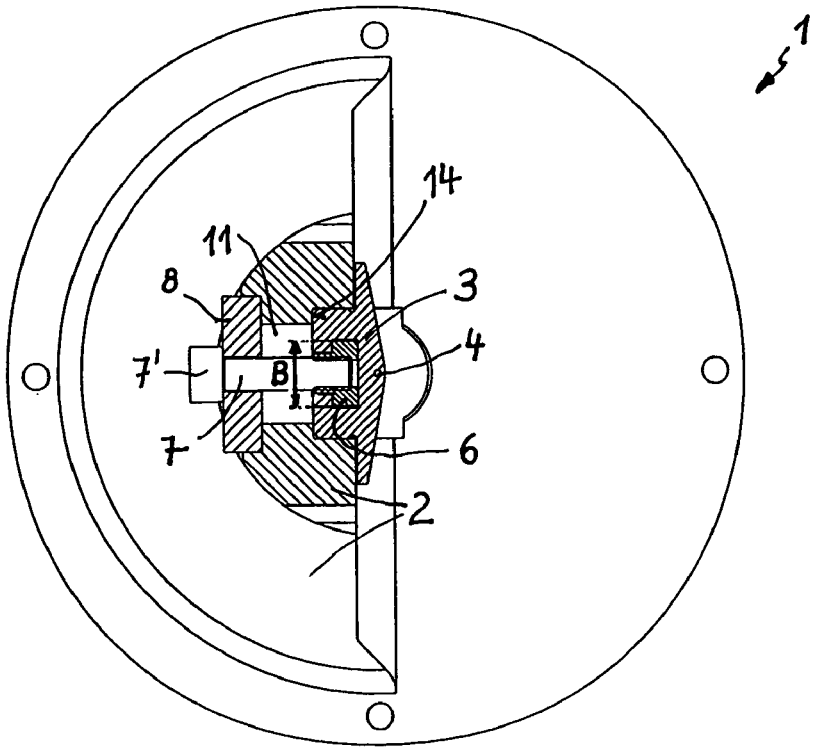
FIG. 2 shows a section through a wire guide array according to FIG. 1 in the sectional position and sectional direction according to I—I from FIG. 1.

On the side of the smaller molded section 6.1 of the molded body 6 facing the collet 2 there are, as shown in FIG. 3, two tapholes 9 into which two fastening screws 7 are screwed from the side facing away from the wire guide block 3 (as shown in FIG. 1) for attaching the wire guide block 3 to the collet 2 (see sectional view in FIG. 2). The screw heads 7' of the two fastening screws 7 are braced against a base plate (8) inserted between them and the facing side of support 2, protrude through an opening 11 made in the collet 2 (see FIG. 1 and 2) and are screwed into one of the tapholes each 9 in the molded body 6 with their penetrating ends. The screw effect of the fastening screws 7 presses the end surface 13 provided on the wire guide block 3 above and below the groove section 5.1 of the molded groove 5 against a corresponding contact surface 14 on the collet 2 and tightened accordingly with the desired pressure. The bracing force on the other side of the collet 2 is also transmitted to the support 2 via the heads 7' of the fastening screws 7 and the inserted base plate 8.

As can be seen clearly from FIGS. 1, 2 and 4, the molded groove 5 in the wire guide block 3 is shaped in such a way that in principle the axis of the cross section M of its T-shaped cross section runs through the middle of the guide groove 4 and is thus central and at the same level as the latter. The molded groove 5 is mounted here on the wire guide block 3 between the guide groove 4 and the support 2 and forms a central clamp attachment on the collet 2 with the molded body 3 tightly inserted in it. The use of special thread inserts on the wire guide block 3 is no longer required. The two tapholes 9 still used for the attachment are located in the molded body 6 and can be manufactured in conjunction with or totally separately from the wire guide block 3, so that even if they are used in the molded body 6, there are no effects on the manufacture or the exact shape of the wire guide block 3.

FIGS. 5 to 8 show only another embodiment for a wire guide 1, which is explained below.

The wire guide 1 in FIGS. 5 to 8 differs from the one in FIGS. 1 to 4 essentially in that, in this case, a divided wire guide block 3 is used. As is shown in particular in the enlarged exploded view in FIG. 8, in this embodiment the wire guide block 3 is divided at the mid-level of the guide groove 4 into two halves 3.1 and 3.2, in a plane E perpendicular to the latter.

FIG. 7 shows the half 3.2 (lying below in FIG. 8). As can be seen clearly, the lower half of the guide groove 4 and the lower half of the molded groove 5 lie in this half, which has a shape other than the one in FIG. 1 to 4.

As FIG. 7 shows, in the embodiment of FIGS. 5 to 8 the molded groove 5 no longer 20 extends over the entire length L of the wire guide block 3 but only over a portion of same. In this case, as shown also in FIG. 7, the first groove section 5.1 that opens toward the collet 2 has a shorter length $L_2$ than length $L_1$ of the adjoining second groove section 5.2 lying further inside the wire guide block 3. The latter, as seen in the longitudinal direction of the wire guide block 3, protrudes a little beyond both sides of the first groove section 5.1, whereby the lower half 3.2 of the wire guide block 3 shown in FIG. 7 shows only half the width b/2 of the first groove section 5.1 and also only half the width B/2 of the second groove section 5.2 (because the upper half 3.1 of the wire guide block 3 is a mirror image of the molded collet 5, so that the molded collet 5 in its entirety only occurs when the halves 3.1 and 3.2 are joined as shown in FIGS. 5 to 8).

The molded body 6 shown in FIG. 3 can be used as molded body also in the molded groove or the molded collet 5 of the wire guide block 3, which consists of two halves 3.1 and 3.2, the same way as in the molded groove 5 of the embodiment in illustrations 1 to 4.

FIG. 8 shows an exploded view of the joined halves 3.1 and 3.2 of the wire guide block 3 with inserted molded body 6 (the hidden groove edges and the edges of the molded body 6 inside the molded groove 5 are shown by broken lines in the illustration).

Figure 6:
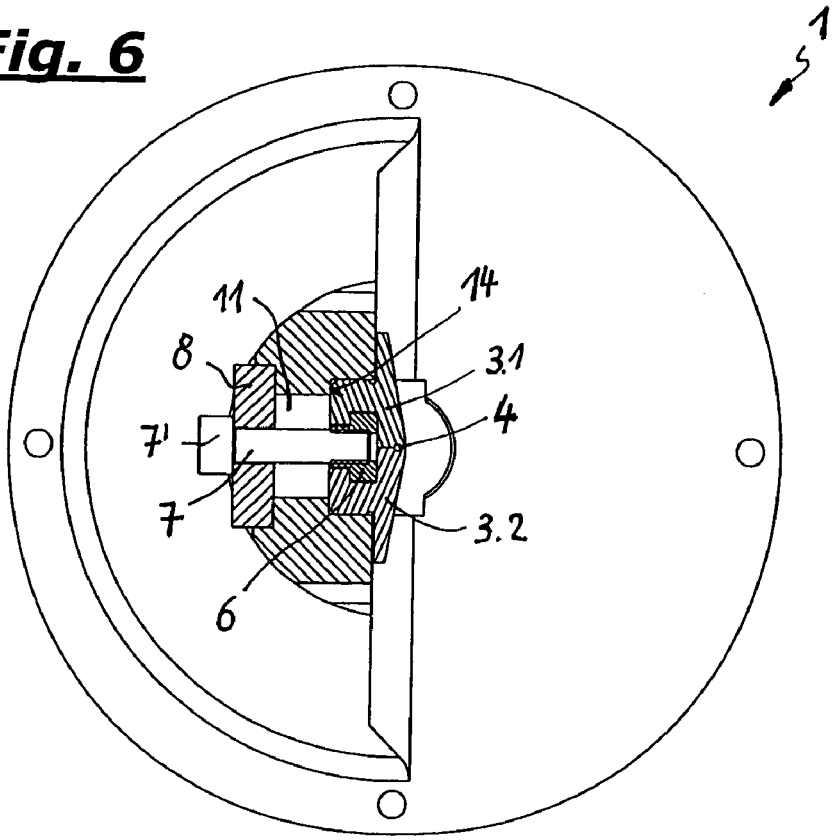
FIG. 6 shows a sectional view corresponding to the sectional view of FIG. 2 through the array of FIG. 5.

As can be seen from the sectional view in FIG. 6, also enlarged, corresponding to the sectional view in FIG. 2, the two halves 3.1 and 3.2 of the divided wire guide block 3 are braced against the collet 2 also only via the centrally mounted molded body 6 tightened via the fastening screws 7. In all other respects the design is the same as for the first example of embodiment in FIGS. 1 to 4.

When using the shown wire guide, a wire (not shown in the illustrations) is fed out from a reel, then is driven via a number of individual rollers and is fed into the wire guide shown in FIG. 1 via a guide (not shown). The purpose of the wire guide is to feed the wire, positioned exactly right, into the working chamber of the wire processing machines, for example, to be there wound into coils. After a coiling procedure of this type, the wire is then, for example, cut in a cutting unit at the leading edge of the wire guide 1, at the opening of the guide groove 4 (also not shown in the illustrations).

The invention claimed is:

1. A wire guide for use with a wire processing machine to guide a wire feed to wire processing tools, the wire guide comprising:

a collet attached to a wire guide block having a guide groove; and a molded body tightly fitted into the wire guide block on a side facing the collet and laterally to the guide groove, and braced against the collet with an attachment member.

2. The wire guide of claim 1, wherein the attachment member includes at least one fastening screw inserted through the collet from a side opposite the wire guide block.

3. The wire guide of claim 2, wherein the molded body fits into a cavity formed in the wire guide block.

4. The wire guide of claim 2, wherein a screw head of the at least one fastening screw is braced against the collet with a base plate positioned therebetween.

5. The wire guide of claim 4, wherein the wire guide block is divided at a mid-level of the guide groove in a plane perpendicular to the guide groove.

6. The wire guide of claim 1, wherein the molded body fits into a cavity formed in the wire guide block.

7. The wire guide of claim 6, wherein the molded cavity is in the form of a molded groove running in a direction of the guide groove and opening toward the side of the collet.

8. The wire guide of claim 7, wherein the molded groove has a generally T-shaped cross section.

9. The wire guide of claim 8, wherein the molded groove extends over the entire length of the wire guide block.

10. The wire guide of claim 8, wherein the molded body has sections, whereby the first section fits into a first section of the molded groove facing the side of the collet, while the second section fits into a second section of the molded groove, and at least one of the length or width of the second section is larger than the respective length or width of the first section of the molded body.

11. The wire guide of claim 7, wherein the molded groove extends over the entire length of the wire guide block.

12. The wire guide of claim 11, wherein a screw head of the at least one fastening screw is braced against the collett with a base plate positioned therebetween.

13. The wire guide of claim 1, wherein the wire guide block is divided at a mid-level of the guide groove in a plane perpendicular to the guide groove.

14. The wire guide of claim 13, wherein the groove extends only over a portion of the total length of the wire guide block.

15. The wire guide of claim 14, wherein the molded groove is generally T-shaped and a first groove section of the molded groove opening toward the collet extends over a shorter length than the length of an adjoining second groove section of the molded groove, forming a cross bar of the generally T-shaped cross section of the molded groove.

16. The wire guide of claim 15, wherein the molded body has two sections, whereby the first section fits into the first section of the molded groove facing the side of the collet, while the second section fits into the second section of the molded groove, and at least one of the length or width of the second section is larger than the respective length or width of the first section of the molded body.

* * * * *